US005468313A

United States Patent [19]

Wallace, II et al.

[11] Patent Number: 5,468,313

[45] Date of Patent: Nov. 21, 1995

[54] PLASTISOL EXPLOSIVE

[75] Inventors: Ingvar A. Wallace, II; Paul C. Braithwaite, both of Brigham City; Jamie B. Neidert, Ogden, all of Utah

[73] Assignee: Thiokol Corporation, Ogden, Utah

[21] Appl. No.: 346,587

[22] Filed: Nov. 29, 1994

[51] Int. Cl.[6] ..... C06B 31/50

[52] U.S. Cl. ..... 149/53; 149/64; 149/65; 149/76; 149/79; 149/93; 149/97

[58] Field of Search ..... 149/38, 49, 50, 149/52, 53, 64, 65, 76, 79, 92, 93, 96, 97

[56] References Cited

U.S. PATENT DOCUMENTS

| | | | |
|---|---|---|---|
| 2,289,317 | 7/1942 | Pratt | 102/12 |
| 3,078,200 | 2/1963 | Preckel | 149/96 |
| 3,086,896 | 4/1963 | Trask et al. | 149/92 |
| 3,088,858 | 4/1953 | Camp | 149/19 |
| 3,375,148 | 3/1968 | Finnegan et al. | 149/18 |
| 3,400,025 | 9/1968 | Hopper et al. | 149/18 |
| 3,489,623 | 1/1970 | Griffith et al. | 149/20 |
| 3,639,183 | 2/1972 | Crescenzo et al. | 149/18 |
| 3,657,028 | 4/1972 | Pannell | 149/19 |
| 3,689,331 | 9/1972 | Pierce | 149/18 |
| 3,767,489 | 10/1973 | Reiwhart et al. | 149/18 |
| 3,793,099 | 2/1974 | Duerksen et al. | 149/19 |
| 3,808,061 | 4/1974 | Pierce | 149/18 |
| 3,943,017 | 3/1976 | Wells | 149/19.8 |
| 3,979,236 | 9/1976 | Sayles | 149/19.8 |
| 4,002,514 | 1/1977 | Plomer et al. | 149/19.4 |
| 4,014,720 | 3/1977 | Wells | 149/19.8 |
| 4,025,370 | 5/1977 | Csanady et al. | 149/92 |
| 4,038,115 | 7/1977 | Dehm | 149/19.8 |
| 4,239,561 | 12/1980 | Camp et al. | 149/19.8 |
| 4,267,132 | 5/1981 | Henderson et al. | 264/3 |
| 4,298,411 | 11/1981 | Godsey | 149/19.4 |
| 4,457,791 | 7/1984 | Gill et al. | 149/19.3 |
| 4,462,848 | 7/1984 | Elrick | 149/19.92 |
| 4,477,297 | 10/1984 | Chi | 149/109.6 |
| 5,192,379 | 3/1993 | Johnson et al. | 149/19.4 |
| 5,205,983 | 4/1993 | Camp et al. | 149/97 |

OTHER PUBLICATIONS

Ronald W. James, *Propellants And Explosives,* Noyes Data Corp., pp. 20–24, (1974).

*Primary Examiner*—Donald P. Walsh
*Assistant Examiner*—Anthony R. Chi
*Attorney, Agent, or Firm*—Ronald L. Lyons; Madson & Metcalf

[57] ABSTRACT

Castable high explosive compositions having a binder system containing plastisol grade nitrocellulose (PNC) and an energetic plasticizer are disclosed. The explosive composition also includes a solid high explosive ingredient, such as an explosive nitramine. Reactive metals, such as aluminum, magnesium or titanium, and oxidizers, such as ammonium perchlorate, ammonium nitrate, or ammonium dinitramide, are optionally included in the explosive compositions of the present invention. The disclosed explosive compositions have a typical detonation velocities above about 8000 m/s.

17 Claims, No Drawings

PLASTISOL EXPLOSIVE

FIELD OF THE INVENTION

The present invention relates to castable high explosive compositions based on plastisol grade nitrocellulose (PNC) and energetic plasticizers which produce high detonation velocities suitable for use in shaped charge, explosively formed penetrator and fragmentation warheads, and mine clearing charge applications.

BACKGROUND OF INVENTION

Castable high explosives are usually prepared by combining an explosive ingredient, such as a nitramine, with a curable binder and optionally a reactive metal and an oxidizer. One widely used binder is hydroxy terminated polybutadiene (HTPB). HTPB is cured using conventional diisocyanate curing agents and cure catalysts. A typical HTPB explosive is PBXN-109, which contains 20 wt. % Aluminum, 64 wt. % RDX (1,3,5-trinitro-1,3,5-triazacyclohexane), and 16 wt. % binder system containing HTPB, DOA (dioctyladipate), and IPDI (isophorone diisocyanate). As shown in this example, the binder system may also contain a plasticizer to aid processing. Once the ingredients are mixed, the cure reaction begins which causes viscosity to increase until the polymer is fully cured. PBXN-109 has a detonation velocity of about 7600 m/s.

The pot life, i.e., the handling time available between mixing and when the composition begins to set up, and cure time of the binder system is dependent on the specific materials used, the mixing and curing temperature, the size of the cured product, and the catalyst concentration. Pot life is typically defined as the point at which the viscosity reaches 40 kP as measured by a Brookfield viscometer. A minimum pot life of 6–10 hours is typically desired to allow casting of the explosive into military warheads. Curing time is dependent upon many factors, but is typically carried out within a week at a typical curing temperature from 135° F. to 145° F. Short cure times are desired for reasons of economy.

There are disadvantages associated with typical cast explosives described above. For instance, because HTPB is an inert binder, it does not enhance the energetic performance of the high explosive composition. In addition, the need for a curing agent and/or cure catalyst not only diminishes the energetic performance, but also complicates the mixing and processing. Moreover, isocyanate curing agents are susceptible to moisture contamination, and cure catalysts are easily poisoned.

Other cast explosives are prepared from nitrocellulose ("NC") binder systems, such as those described in U.S. Pat. No. 3,943,017 to Wells. The Wells binder systems include a small amount of nitrocellulose and a large amount of liquid plasticizer. The ratio of plasticizer to nitrocellulose is from 6.5:1 to 15:1. The reason Wells requires such large amounts of plasticizer is because nitrocellulose begins to swell and gelate immediately during mixing. Plasticizers are needed to keep the viscosity low enough to permit processing.

A Navy explosive, PBXN-103, is prepared with a plastisol grade nitrocellulose ("PNC") binder. PBXN-103 has the following ingredients:

| Ingredient | Weight Percent |
|---|---|
| Ammonium perchlorate | 40 |
| Aluminum | 27 |
| TMETN | 23 |
| TEGDN | 2.5 |
| PNC | 6 |
| Ethyl centralite | 1.3 |
| Resorcinol | 0.2 |

TMETN (trimethylolethanetrinitrate) and TEGDN (triethyleneglycoldinitrate) are energetic plasticizers. Ethyl centralite and resorcinol are stabilizers. PBXN-103 hardens via gelation or physical bonding rather than by chemical cross-linking. PBXN-103 is designed for underwater use or other low oxygen environments. It contains a large amount of ammonium perchlorate and aluminum to provide the high combustion temperature. The PBXN-103 explosive also contains high quantities of plasticizer relative to the PNC binder. PBXN-103 is a low brisance explosive, having a relatively low detonation velocity of about 6000 m/s. Because of the low detonation velocity, PBXN-103 is not well suited for use in high performance precision shaped charges and EFP's (explosively formed penetrators).

From the foregoing, it would be an advancement in the art to provide a high performance castable explosive which is easily processed and which produces a high detonation velocity suitable for use in shaped charge, explosively formed penetrator warhead, fragmentation warhead, and mine clearing charge applications.

Such high performance castable high explosive compositions are disclosed and claimed herein.

SUMMARY OR THE INVENTION

The present invention relates to castable high explosive compositions having a binder system containing plastisol grade nitrocellulose (PNC) and an energetic plasticizer. PNC should not be confused with nitrocellulose (NC). NC used in conventional binder systems swells quickly and begins gelation during mixing. In contrast, PNC does not begin gelation at an appreciable rate until it is heated above a certain threshold temperature, typically 145° F. Thus, with NC the gelling process begins during the mixing process while PNC does not gel appreciably until it is heated.

The ratio of energetic plasticizer to PNC is in the range from about 0.5 to 5, and preferably from about 2 to 4. The explosive composition includes a solid high explosive ingredient, such as an explosive nitramine. The high explosive preferably has a concentration in the explosive composition in the range from about 50 to 80 weight percent, and more preferably from about 60 to 70 weight percent. Reactive metals, such as aluminum, magnesium or titanium, and oxidizers, such as ammonium perchlorate, ammonium nitrate, or ammonium dinitramide, are optionally included in the explosive compositions of the present invention. The explosive compositions described herein preferably have a detonation velocity above 8000 m/s, and most preferably in the range from 8000 m/s to 9000 m/s.

Because the PNC binder system gels only when heated, the castable PNC explosives described herein have extremely long pot lives. The working viscosity and pot life are controlled by controlling the processing temperature. In addition, the PNC binder system does not require a curing agent or cure catalyst, thereby simplifying the mixing and processing procedure and increasing reliability.

Importantly, because the castable high explosive compositions of the present invention include an energetic binder and energetic plasticizer in combination with high amounts of high explosive, such as explosive nitramines, the castable high explosive compositions described herein have detonation velocities comparable to pressed explosives. In fact, the detonation velocities reported herein are greater than any other currently fielded castable explosive. Thus, the use of PNC in the binder system provides significant advantages over conventional castable explosive compositions in both processing and performance characteristics.

DETAILED DESCRIPTION OF THE INVENTION

The present invention is directed to a family of extremely powerful and energetic castable explosives. The explosives are prepared using a binder system containing plastisol grade nitrocellulose (PNC) and an energetic plasticizer. The explosive composition also includes a solid high explosive ingredient, such as an explosive nitramine. Reactive metals and oxidizers are optionally included in the explosive compositions of the present invention.

The PNC binder system has several advantages relative to conventional energetic and non-energetic cast/cure binders. For example, the binder provides superior energy density and performance, no curative or cure catalyst is required, virtually any desirable processing life may be obtained, and the end-of-mix (EOM) viscosity can be tailored by adjusting the mix temperature and the extent of PNC swelling.

Plastisol grade nitrocellulose (PNC) is very different from nitrocellulose (NC). NC used in conventional binder systems swells instantly and begins gelation during mixing. In contrast, PNC does not gel at an appreciable rate until it is heated above a certain threshold temperature, typically 145° F.

PNC may be obtained from the Naval Surface Warfare Center, Indian Head, Md. PNC is prepared in batches by placing 90 grams of dry nitrocellulose (12.6% N), 1.2 grams ethyl centralite, and 1.4 liters of nitromethane in a flask and stirring vigorously until apparent dissolution occurs, then stirring slowly for 10 minutes more to insure homogeneity in the resulting lacquer. About 19.2 grams of suitable petroleum sulfonate emulsifying agent, for example Petromix No. 9, in about 900 ml of water is added to the lacquer and the mixture circulated and recirculated through a colloid mill wherein the liquid has to pass between a stator and rotor which have only a small clearance while the rotor rotates at about 10,000 rpm.

After 10 minutes, the emulsion is drained from the colloid mill into about 30 liters of stirred water and stirred for about 15 minutes whereupon a precipitate of nitrocellulose forms. Then the precipitate is filtered out of the liquid, washed in hexane and dried for about 16 hours. Then the nitrocellulose is sifted through a 200 mesh screen. The above procedure yields dense, spherical plastisol grade nitrocellulose particles of 1 to 30 μ median diameter. The PNC is not substantially attacked by the plasticizers until cure at elevated temperature is initiated. Small amounts of conventional stabilizers are added. Ethyl centralite and N-methyl-p-nitroanaline are widely used to stabilize nitrocellulose.

Known and novel energetic plasticizers may be used in combination with the PNC, such as bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), or mixtures thereof. BTTN is a currently preferred energetic plasticizer. The explosive compositions according to the present invention typically include from 15% to 40% plasticizer, by weight, and preferably from 20% to 30% plasticizer, by weight. The plasticizer/polymer (PNC) ratio (Pl/Po) may range from 0.5 to 5, depending on the solids loading. The Pl/Po ratio is preferably from 2 to 4.

Typical high explosives which can be used in the present invention include known and novel nitramines and other high explosives such as CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetra-nitro- 1,3,5,7-tetraazacyclooctane), TEX (4,10-dinitro-2,6,8,12-tetraoxa-4,10-diazatetracyclo[5.5.0.0$^{5,9}$.0$^{3,11}$] dodecane), NTO (3-nitro-1,2,4-triazol-5-one), NQ (nitroguanidine), TAG nitrate (triaminoguanidinium trinitrate), PETN (pentaerythritol tetranitrate), TATB (1,3,5-triamino-2,4,6-trinitrobenzene), TNAZ (1,3,3-trinitroazetidine), ADN (ammonium dinitramide), DADNE (1,1-diamino-2,2-dinitro ethane), and mixtures thereof. Those skilled in the art will appreciate that other known and novel high explosives not listed above may also be used in the present invention. The high explosive will typically be present in a concentration from 50 wt. % to 80 wt. % and preferably from 60 wt. % to 70 wt. % of the total explosive composition. Polymodal particle size distributions of the high explosive are preferably used to obtain weight percent concentrations above about 65 percent.

Reactive metals may optionally be added to the explosive compositions of the present invention to achieve high heats of reaction. The reactive metal is preferably aluminum or magnesium, although other reactive metals may also be used such as boron, titanium, zirconium, silicon, or mixtures thereof. Selected metal alloys may also be used, such as aluminum/magnesium and aluminum/lithium alloys. These types of alloys have been used successfully in the solid rocket propellant industry. Such alloys react more completely than pure metals by virtue of the increased reactivity and lower ignition and cutoff temperatures. Increased metal reactivity further improves overall combustion efficiency which translates into the generation of greater amounts of heat during the reaction of the explosive. The reactive metal content of the explosive compositions within the scope of the present invention typically ranges from 0 wt. % to 20 wt. %, more preferably from 5 wt. % to 10 wt. %.

An oxidizer may optionally be included in the explosive compositions according to the present invention to assist in metal combustion. Typical oxidizers are preferably selected from AP (ammonium perchlorate) or AN (ammonium nitrate), although other oxidizers can be used such as HAN (hydroxylammonium nitrate), ADN (ammonium dinitramide), lithium perchlorate, potassium perchlorate, lithium nitrate, or mixtures thereof. Useful oxidizers are characterized by high density and oxygen content. The oxidizer will typically be present in a concentration from 0 wt. % to 20 wt. % of the total explosive composition.

The explosive compositions are prepared according to the following general procedure. First, an energetic plasticizer in a desensitizing solvent is added to a mix bowl. A stabilizer is added to the bowl, and mixing under vacuum begins. Mixing proceeds until all the solvent is removed from the plasticizer/stabilizer mixture. Next, PNC wet with heptane is added to the mix bowl. Heptane serves to desensitize the PNC. Mixing proceeds under ambient pressure for about 15 minutes. Once the "binder" is well blended, the high explosive ingredient is added, usually incrementally, until all is added. Mixing continues under vacuum to remove the heptane from the mixture. The explosive compositions have a typical pot life of 24 hours at a processing temperature of 80° F.–90° F. The samples are then cast under vacuum to remove entrained air from the explosive composition.

The present invention is further described in the following nonlimiting examples.

EXAMPLE 1

A series of quarter-pint mixes of castable plastisol explosives were prepared having the following ingredients:

| Ingredient | Formulation 1A | 1B | 1C | 1D |
|---|---|---|---|---|
| PNC | 16.81 | 9.55 | 12.80 | 9.83 |
| BTTN | 31.94 | 19.20 | 25.70 | 19.67 |
| Triacetin | 0.75 | 0.75 | 1.00 | 0.00 |
| MNA | 0.50 | 0.50 | 0.50 | 0.50 |
| HMX (unground) | 40.00 | 50.00 | 45.00 | 56.00 |
| HMX (20 μ) | 10.00 | 20.00 | 15.00 | 0.00 |
| HMX (1.9 μ) | 0.00 | 0.00 | 0.00 | 14.00 |

The explosive compositions were prepared by adding the BTTN plasticizer (in methylene chloride) and MNA (stabilizer) to a mix bowl and then mixing under vacuum. Mixing continued until all the solvent was removed from the BTTN/MNA mixture. Next, PNC wet with heptane was added to the mix bowl. Mixing continued under ambient pressure for about 15 minutes. Once the binder system was well blended, the HMX was added incrementally, until all was added. Mixing continued under vacuum to remove the heptane from the mixture. The mix bowl temperature and end-of-mix (EOM) viscosity were measured. The samples were then cast under vacuum.

The mix bowl temperature and EOM viscosity were as follows:

| | Formulation 1A | 1B | 1C | 1D |
|---|---|---|---|---|
| Bowl Temperature | 100° F. | 90° F. | 90° F. | 90° F. |
| EOM Viscosity | 1 kP | >100 kP | 2.1 kP | 17 kP |

Compositions 1C and 1D were tested to determine safety characteristics. Safety tests were run using standard methodologies common the those skilled in the art. It should noted that TC (Thiokol Corporation) tests are 50% fire values and ABL (Allegheny Ballistics Laboratory) numbers are threshold initiation values. The results were as follows:

| | Impact | | Friction | | ESD | |
|---|---|---|---|---|---|---|
| | TC (in) | ABL (cm) | TC (lb) | ABL (psi @ ft/s) | TC (J) | SBAT (°F.) |
| 1C (uncured) | 8 | 26 | 63 | 180 @ 8 | >8 | 260 |
| 1C (cured) | 15 | 26 | 60 | 800 @ 8 | >8 | 256 |
| 1D (uncured) | <4 | 21 | 62 | 660 @ 8 | >8 | 229 |
| 1D (cured) | 20 | 41 | >64 | 660 @ 8 | ≧8 | >300 |

ESD = Electrostatic Discharge
SBAT = Simulated Bulk Autoignition Temperature.

These data are typical of high performance explosives. The autoignition temperature is far below the nitramine decomposition temperature. This indicates that the nitrate esters and nitrocellulose are controlling the decomposition temperature which could reduce the reaction violence when a sample is subjected to slow cook-off.

EXAMPLE 2

A castable plastisol explosive was prepared according to the procedure of Example 1 having the following ingredients expressed in weight percent:

| Ingredient | 2A |
|---|---|
| PNC | 13.17 |
| BTTN | 26.33 |
| MNA | 0.50 |
| RDX | 60.00 |

The end-of-mix (EOM) viscosity was 2 kP.

EXAMPLE 3

A series of castable plastisol explosives were prepared according to the procedure of Example 1. The processibility and mechanical properties of castable plastisol explosives were examined as a function of HMX level, HMX particle size distribution, and plasticizer to polymer ratio (Pl/Po). The HMX particle size distribution is expressed as relative amounts of 105 micron, 20 micron, and 1.9 micron HMX. The Pl/Po ratio is the ratio of BTTN to PNC. The results are set forth below in Table 1.

TABLE 1

| HMX (%) | Pl/Po | HMX Dist. | EOM Visc. (kP) | Modulus (psi) | Stress (psi) | Strain (%) |
|---|---|---|---|---|---|---|
| 60 | 3.0 | 100/0/0 | 1 | 1030 | 71 | 38 |
| 60 | 2.0 | 100/0/0 | 1 | 1877 | 78 | 32 |
| 60 | 3.0 | 80/0/20 | 1 | 1470 | 83 | 12 |
| 60 | 2.0 | 80/0/20 | 2 | 2422 | 79 | 11 |
| 60 | 3.0[A] | 70/30/0 | 1 | 1180 | 68 | 10 |
| 60 | 2.0 | 70/30/0 | 2 | 2049 | 80 | 27 |
| 60 | 3.0 | 50/30/20 | 1 | 1760 | 97 | 11 |

TABLE 1-continued

| HMX (%) | Pl/Po | HMX Dist. | EOM Visc. (kP) | Modulus (psi) | Stress (psi) | Strain (%) |
|---|---|---|---|---|---|---|
| 60 | 2.0 | 50/30/20 | 4 | 2667 | 105 | 7 |
| 60 | 1.0 | 50/30/20 | 106 | — | — | — |
| 60 | 2.0 | 0/30/70 | 21 | 3422 | 105 | 5 |
| 60 | 2.0[B] | 75/25/0 | 2 | 1584 | 121 | 78 |
| 65 | 1.5 | 75/15/10 | 17 | 2653 | 73 | 3 |
| 65 | 2.5 | 75/15/10 | 2 | 2460 | 78.1 | 6 |
| 70 | 3.0[A] | 100/0/0 | 70 | — | — | — |
| 70 | 2.0 | 100/0/0 | 120 | 1142 | 33 | 4 |
| 70 | 3.0 | 80/0/20 | 7 | 2430 | 96 | 5 |
| 70 | 2.0 | 80/20/0 | 17 | 2097 | 49 | 3 |
| 70 | 3.0[A] | 70/30/0 | 7 | 1880 | 59 | 5 |
| 70 | 2.0 | 70/30/0 | 150 | 2103 | 53 | 2 |
| 70 | 3.0 | 50/30/20 | 10 | 2430 | 78 | 4 |
| 70 | 2.0 | 50/20/30 | 20 | 1920 | 53 | 3 |

[A]Used a different lot of PNC.
[B]Contained one percent triacetin.

From the results of Table 1, many of the explosive formulations are not only castable, but pourable. For a given HMX level, EOM viscosity is improved with increasing plasticizer-to-polymer mechanical properties deteriorated as the HMX level was increased.

EXAMPLE 4

The theoretical performance of plastisol explosives as a function of HMX level and plasticizer to polymer ratio (Pl/Po) was determined. Theoretical performance calculations were performed using the TIGER nonideal thermoequilibrium code with the Becker-Kistiakowsky-Wilson equation of state. The results are reported below in Table 2. All formulations contained 0.5 percent stabilizer (MNA). The Pl/Po ratio is of BTTN to PNC.

TABLE 2

| HMX (%) | Pl/Po | Density (g/cc) | Detonation Velocity (m/s) | Detonation Pressure (katm) |
|---|---|---|---|---|
| 60 | 1 | 1.759 | 8497 | 325.3 |
| 65 | 1 | 1.775 | 8563 | 332.9 |
| 70 | 1 | 1.791 | 8630 | 340.5 |
| 60 | 2 | 1.747 | 8487 | 323.2 |
| 65 | 2 | 1.765 | 8556 | 331.1 |
| 70 | 2 | 1.782 | 8622 | 338.8 |
| 60 | 3 | 1.742 | 8485 | 322.5 |
| 65 | 3 | 1.759 | 8549 | 329.9 |
| 70 | 3 | 1.778 | 8620 | 338.2 |

EXAMPLE 5

A one-pint mix of a castable plastisol explosive composition was prepared according to the general procedure of Example 1. The mix had the ingredients of formulation 1D. The EOM viscosity was 33 kP. The explosive from this mix was cast into two each NOL card gap pipes. The density of the explosive in these pipes was determined to be 1.726 g/cc for pipe number 1 and 1.738 g/cc for pip number 2. The NOL card gap pipes were prepared to allow the measurement of the detonation velocity using ionization pins at 1-, 2-, 3-, 4-, and 5-inch from the end of the pip next to the booster explosive.

Detonation of explosive in pipe number 1 and 2 resulted in detonation velocities of 8846 m/s and 8694 m/s respectively. The average velocity of 8,770 m/s measured for this explosive is considerably higher than known castable high performance explosive, such as PBXN-110, which has a detonation velocity of 8391 m/s at a density of 1.68 g/cc. PBXN-110 includes 88% HMX and 12% HTPB binder. Furthermore, the detonation velocity for this explosive is essentially equal to the high solids pressed explosive PBX-9404 (94 percent HMX, three percent NC, and three percent tris-beta chlorethylphosphate) which has a detonation velocity of 8802 m/s at a density of 1.844 g/cc.

Because of the high detonation velocity, high performance castable explosive compositions of the present invention are well suited for use in shaped charge, explosively formed penetrator warhead, fragmentation warhead, and mine clearing charge applications. Importantly, the high detonation velocity is obtained with a smaller quantity of HMX. Thus, another advantage of the present invention is the potential reduction in sensitivity due to the substantial reduction in the level of nitramines used.

Another significant distinction between the present cast high explosives and conventional cast explosives prepared from cross-linked polymeric binders and curing agents, is the ease of demilitarization and disposal. The explosive compositions of the present invention dissolve in acetone and the solids are easily recovered and reused.

From the foregoing, it will be appreciated that the present invention provides high performance castable explosives which are easily processed and which produce a high detonation velocity suitable for use in shaped charge, explosively formed penetrator warhead, fragmentation warhead, and mine clearing charge applications.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

The claimed invention is:

1. A castable explosive composition comprising:

a plastisol nitrocellulose (PNC) binder;

an energetic plasticizer, wherein the ratio of energetic plasticizer to PNC is in the range from about 0.5 to 5, by weight; and a high explosive having a concentration in the explosive composition greater than 65 weight percent, wherein the explosive composition has a detonation velocity above 8000 m/s.

2. A castable explosive composition as defined in claim 1, wherein the high explosive is a nitramine explosive.

3. A castable explosive composition as defined in claim 1, wherein the high explosive is selected from CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4,10-diazatetracyclo[5.5.0.0$^{5,9}$.0$^{3,11}$]-dodecane), NTO (3-nitro-1,2,4-triazol-5one), NQ (nitroguanidine), TAG nitrate (triaminoguanidinium trinitrate), PETN (pentaerythritol tetranitrate), TATB (1,3,5-triamino- 2,4,6-trinitrobenzene), TNAZ (1,3,3-trinitroazetidine), ADN (ammonium dinitramide), DADNE (1,1-diamino-2,2-dinitro ethane), and mixtures thereof.

4. A castable explosive composition as defined in claim 1, wherein the energetic plasticizer is selected from bis(2,2-dinitropropyl)acetal/bis(2,2-dinitropropyl) formal (BDNPF/BDNPA), trimethylolethanetrinitrate (TMETN), triethyleneglycoldinitrate (TEGDN),diethyleneglycoldinitrate (DEGDN), nitroglycerine (NG), 1,2,4-butanetrioltrinitrate (BTTN), alkyl nitratoethylnitramines (NENA's), and mixtures thereof.

5. A castable explosive composition as defined in claim 1, wherein the ratio of energetic plasticizer to PNC is in the range from about 2 to 4, by weight.

6. A castable explosive composition as defined in claim 1, wherein the energetic plasticizer has a concentration in the explosive composition from about 15% to 40%, by weight.

7. A castable explosive composition as defined in claim 1, wherein the energetic plasticizer has a concentration in the explosive composition from about 20% to 30%, by weight.

8. A castable explosive composition as defined in claim 1, further comprising a reactive metal having a concentration in the explosive composition from 0 to about 20 weight percent.

9. A castable explosive composition as defined in claim 1, further comprising an oxidizer having a concentration in the explosive composition from 0 to about 20 weight percent.

10. A castable explosive composition comprising:

a plastisol nitrocellulose (PNC) binder;

an energetic plasticizer having a concentration in the explosive composition from about 15% to 40%, by weight, wherein the ratio of energetic plasticizer to PNC is in the range from about 0.5 to 5, by weight; and a high explosive having a concentration in the explosive composition greater than 65 weight percent;

a reactive metal selected from aluminum, magnesium, boron, titanium, zirconium, silicon, mixtures, and alloys thereof, said reactive metal having a concentration in the explosive composition from 0 to about 20 weight percent;

an oxidizer selected from ammonium perchlorate (AP), ammonium nitrate (AN), ammonium dinitramide (ADN), hydroxylammonium nitrate (HAN), ammonium dinitramide (ADN), lithium perchlorate, potassium perchlorate, lithium nitrate, and mixtures thereof, said oxidizer having a concentration in the explosive composition from 0 to about 20 weight percent; and wherein the explosive composition has a detonation velocity above 8000 m/s.

11. A castable explosive composition as defined in claim 10, wherein the high explosive is a nitramine explosive.

12. A castable explosive composition as defined in claim 10, wherein the high explosive is selected from CL-20 (2,4,6,8,10,12-hexanitro-2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro-l,3,5,7-tetraazacyclooctane), TEX (4,10-dinitro-2,6,8,12-tetraoxa-4,10-diazatetracyclo[5.5.0.0$^{5,9}$.0$^{3,11}$]dodecane), NTO (3-nitro-1,2,4-triazol-5-one), NQ (nitroguanidine), TAG nitrate (triaminoguanidinium trinitrate), PETN (pentaerythritol tetranitrate), TATB (1,3,5-triamino- 2,4,6-trinitrobenzene), TNAZ (1,3,3-trinitroazetidine), ADN (ammonium dinitramide), DADNE (1,1-diamino-2,2-dinitro ethane), and mixtures thereof.

13. A castable explosive composition as defined in claim 11, wherein the energetic plasticizer is selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), and mixtures thereof.

14. A castable explosive composition as defined in claim 10, wherein the energetic plasticizer has a concentration in the explosive composition from about 20% to 30%, by weight.

15. A castable explosive composition comprising:

a plastisol nitrocellulose (PNC) binder;

an energetic plasticizer having a concentration in the explosive composition from about 15% to 40%, by weight, selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), and mixtures thereof, wherein the ratio of energetic plasticizer to PNC is in the range from about 1 to 3, by weight;

a high explosive having a concentration in the explosive composition greater than 65 weight percent, wherein the high explosive is selected from CL-20 (2,4,6,8,10,12-hexanitro2,4,6,8,10,12-hexaazatetracyclo[5.5.0.0$^{5,9}$.0$^{3,11}$]-dodecane), RDX (1,3,5-trinitro-1,3,5-triazacyclohexane), HMX (1,3,5,7-tetranitro- 1,3,5,7-tetraazacyclooctane), TEX (4,10-dinitro2,6,8,12-tetraoxa-4,10-diazatetracyclo[5.5.0.0$^{5,9}$.0$^{3,11}$] dodecane), PETN (pentaerythritol tetranitrate), TNAZ (1,3,3-trinitroazetidine), and mixtures thereof;

a reactive metal selected from aluminum, magnesium, boron, titanium, zirconium, silicon, mixtures, and alloys thereof, said reactive metal having a concentration in the explosive composition from 0 to about 20 weight percent;

an oxidizer selected from ammonium perchlorate (AP), ammonium nitrate (AN), ammonium dinitramide (ADN), hydroxylammonium nitrate (HAN), ammonium dinitramide (ADN), lithium perchlorate, potassium perchlorate, lithium nitrate, and mixtures thereof, said oxidizer having a concentration in the explosive composition from 0 to about 20 weight percent; and wherein the explosive composition has a detonation velocity above 8000 m/s.

16. A castable explosive composition as defined in claim 15, wherein the reactive metal has a concentration in the explosive composition from about 5% to 10%, by weight.

17. A castable explosive composition as defined in claim 15, wherein the energetic plasticizer has a concentration in the explosive composition from about 20% to 30%, by weight.

* * * * *